United States Patent [19]

Hall

[11] 3,936,546

[45] Feb. 3, 1976

[54] PROLONGING THE STABILITY OF COATING BATHS

[75] Inventor: Wilbur S. Hall, Plymouth Meeting, Pa.

[73] Assignee: Amchem Products, Inc., Ambler, Pa.

[22] Filed: May 31, 1973

[21] Appl. No.: 365,699

Related U.S. Application Data

[63] Continuation of Ser. No. 152,994, June 14, 1971, abandoned.

[52] U.S. Cl. ..... 427/375; 427/309; 427/435

[51] Int. Cl.[2] ..... B05D 1/18; B04D 3/10

[58] Field of Search ..... 117/132 C, 113; 148/6.15 Z, 6.15 R, 6.27; 106/1; 427/435, 309, 375

[56] References Cited

UNITED STATES PATENTS

| | | | |
|---|---|---|---|
| 3,420,715 | 1/1969 | Ayres | 148/6.16 |
| 3,514,343 | 5/1970 | Bauman | 148/6.2 |
| 3,585,084 | 6/1971 | Steinbrecher et al. | 148/6.2 |
| 3,592,699 | 7/1971 | Steinbrecher et al. | 148/6.2 |
| 3,647,567 | 3/1972 | Schweri | 148/6.15 |

FOREIGN PATENTS OR APPLICATIONS

| | | | |
|---|---|---|---|
| 1,099,461 | 1/1968 | United Kingdom | 148/6.2 |

*Primary Examiner*—Harry J. Gwinnell
*Attorney, Agent, or Firm*—Synnestvedt & Lechner

[57] ABSTRACT

Polymeric resinous coatings are formed on metallic surfaces by immersing them in an acidic aqueous coating composition comprising an oxidizing agent and a coating-forming polymeric resin dispersed in said composition by a dispersing agent said resin and dispersing agent being present in a predetermined proportion. The coating composition tends to become unstable as it is used. The stability of the coating composition is maintained by controlling the amounts of metal ions which tend to build-up in the bath and/or the dispersing agent. Specifically, dispersing agent and resin are added to said coating composition in amounts to replenish these ingredients and in a proportion such that the proportion of said added dispersing agent to said added resin is greater than said predetermined proportion and sufficient to maintain the stability of the dispersed resin in the composition thereby prolonging the operability of the coating composition.

26 Claims, No Drawings

PROLONGING THE STABILITY OF COATING BATHS

FIELD AND BACKGROUND OF INVENTION

This is a continuation, of application Ser. No. 152,994, filed June 14, 1971, now abandoned.

This invention relates to the application of resinous coatings to metallic surfaces. More specifically, this invention relates to a method for maintaining the stability of a resinous coating composition which is used to coat metallic surfaces by immersing them in the composition.

There are disclosed in co-pending applications Ser. Nos. 791,762 and 791,801, each filed on Jan. 16, 1969, now U.S. Pat. Nos. 3,592,699 and 3,585,084 respectively, in the names of Steinbrecher and the present applicant a unique method and composition for applying resinous coatings to objects having metallic surfaces. (The disclosures of the aforementioned applications are incorporated herein by reference.) The resinous coatings are formed by immersing or dipping the metallic surfaces in an acidic aqueous coating composition comprising an organic coating-forming material and an oxidizing agent. Examples of organic coating-forming materials which can be utilized in the invention described in the aforementioned applications are polymeric resinous film-forming materials such as polyethylene, poly-acrylics, and styrene-butadiene copolymers. The film-forming material can be present in the acidic aqueous coating composition in dissolved, emulsified or dispersed form. Examples of oxidizing agents used in the coating composition are hydrogen peroxide, dichromate, perborate, bromate, permanganate, nitrite, nitrate and chlorate. A preferred coating composition is an acidic aqueous composition comprising fluoride ion, an oxidizing agent selected from the class consisting of hydrogen peroxide and dichromate, and particles of a film-forming resin dispersed in the composition, wherein the fluoride ions are added to the composition in the form of hydrofluoric acid and wherein the pH of the composition is within the range of about 1.6 to about 3.8.

Coatings formed from the above described coating compositions have excellent corrosion resistant and paint adherent properties. They can be used as a prepain coating. Or they can be used as a final finish on the metallic surface.

Coating compositions described in the aforementioned applications have a number of extremely important unique characteristics. For example, the coating compositions are effective in forming resinous coatings, the weights or thicknesses of which are related to the time the metallic surface is immersed in the composition. The longer the time of immersion, the heavier or thicker the coating. This characteristic is not possessed by known organic coating compositions. For example, it is known that a conventional latex, that is a dispersion of a film-forming polymeric material in water, can be utilized to form organic coatings on metallic surfaces by immersing the surface in a bath of the latex; however, the thickness of the resultant coating is substantially the same regardless of how long the surface is immersed. In essence, the weight or thickness of a coating that can be obtained from a particular latex is limited when the surface is simply immersed therein. In order to build up the thickness of the coating, applicators have subjected metallic surfaces to a multiple stage coating operation in an effort to attain a coating of the desired thickness. Such operation includes immersing the metallic surface in a latex bath, withdrawing the surface, drying or fusing (as by heating) the coating formed thereon and then repeating the immersion and drying steps until the thickness of the coating is satisfactory. This, of course, is a time-consuming and costly operation. Moreover, the resins of some film-forming latices do not adhere to themselves readily and efforts to build up layer upon layer of the resin have been frustrated or special techniques must be utilized. This further adds to the cost of the multiple stage application process. These disadvantages can be avoided by the use of the compositions described in the aforementioned applications.

Another undesirable characteristic of known aqueous organic film-forming compositions is that the coating deposited on the metallic surface is not initially adherent to the surface. For example, the coating cannot be rinsed without removing virtually all of the coating from the surface. This evidences a lack of adherence to the substrate. On the other hand, the coatings formed from the compositions described in the aforementioned patents are initially adherent to the substrate and resist being rinsed therefrom even when they are still wet.

Another shortcoming of utilizing known organic film-forming compositions is that little or no coating is formed on the edges of the metallic article. However, coatings formed from the compositions described in the aforementioned patents adhere to the edges of the article.

A problem that has been encountered in the use of coating compositions described in the aforementioned patents is that as the composition is used to coat quantities of metallic surfaces, the composition eventually becomes unstable. Instability of the composition is characterized by floculation, coagulation, or gelling of the resinous coating-forming material. After the composition becomes unstable, it can no longer be used effectively to coat metallic surfaces. For all practical purposes the composition is rendered inoperative.

Abortive attempts were made to preserve the stability of the bath of coating composition by replenishing the ingredients comprising the composition as they were depleted during the use of the composition, However, it was found that replenishment of the ingredients was not effective to maintain the stability of the composition. By way of example, it is noted that a replenished coating composition became unstable notwithstanding that the amounts of ingredients in the composition were about the same immediately prior to its becoming unstable as when the composition was being used to effectively form coatings on metallic surfaces immersed therein.

This invention is directed to maintaining the stability of a bath of resinous coating composition of the type described in the aforementioned patents.

BRIEF DESCRIPTION OF THE INVENTION

In accordance with this invention, it has been found that an acidic aqueous coating composition comprising (1) a coating-forming resin dispersed in the composition by a dispersing agent associated therewith and (2) an oxidizing agent can be maintained in a stable coating-forming state as it is used to coat a plurality of metallic surfaces which are immersed therein by controlling the amounts of (1) excess oxidized metallic ions which build-up in the coating composition and (2) the dispersing agent in the composition to maintain them in a proportion effective to prevent said dispersed resin from becoming unstable throughout the composition.

By way of explanation, it is noted that the coating-forming resinous ingredient of the coating composition described herein is water insoluble and is dispersed uniformly in the aqueous phase of the composition by surfactants or dispersing agents associated therewith. However, as the coating composition is used, the dispersing agent is rendered ineffective to maintain the resin particles uniformly distributed throughout the aqueous phase by metallic ions which build-up in the composition. For example, when an iron surface is immersed in the acidic aqueous composition, ferrous ions are dissolved from the metallic surface and are oxidized by the oxidizing agent of the composition to ferric ions. During initial use of the composition, the ferric ions function to render the dispersed resin particles unstable in the region of the metallic surface. It is believed that the ferric ions function to render the dispersing agent ineffective for maintaining the resin particles to their dispersed state. The unstabilized resin particles deposit on the metallic surface. However as additional metallic surfaces are immersed in the composition, the amount of ferric ions in the composition tends to build-up with the result that the dispersed resin becomes unstable, not only in the region of the metallic surface, but also in other portions of the coating composition. As this occurs, the dispersed resin begins to coagulate, flocculate or gel throughout the bath of coating composition. This renders the bath unstable and eventually inoperative.

In accordance with the invention, the bath of coating composition can be maintained stable as it is used to coat a plurality of metal objects by controlling the amounts of oxidized metallic ions which tend to cause the instability problem, referred to herein as "excess oxidized metallic ions", and the dispersing agent for maintaining the resin particles in their dispersed state in a proportion effective to prevent said dispersed resin from becoming unstable in the composition except in the region of the metallic surface. As will be explained in detail hereinbelow, said effective proportion of excess oxidized metallic ions and dispersing agent can be maintained either by removing the excess oxidized metallic ions from the composition, for example, by precipitation thereof, or by adding additional dispersing agent to the composition. In utilizing the latter method, the amount of dispersing agent added must be over and above that which is normally associated with an aqueous dispersed resin which is used to replenish the resinous ingredient as it is depleted during use of the composition. The stability of the bath can be maintained also by using a combination of both the aforementioned steps, that is by adding additional dispersing agent and removing said excess oxidized metallic ions.

When coating iron surfaces, a preferred method for removing excess ferric ions is precipitation thereof by adding calcium hydroxide to the coating composition.

DETAILED DESCRIPTION OF THE INVENTION

As mentioned hereinabove, coating compositions for use in this invention comprise an acidic aqueous coating composition containing a coating-forming resin dispersed in said composition by a dispersing agent associated therewith and an oxidizing agent.

It is believed that this invention will have its widest application of use with compositions which contain a coating-forming polymeric resin which is dispersed in the aqueous phase of the coating composition in the form of liquid or solid particles. Such resin dispersions are referred to generally as "latices".

Speaking generally, the resin particles are maintained in their dispersed state by one or more dispersing agents which are associated with the particles, as by being absorbed on the surfaces of the individual particles. The dispersing agent function to keep the particles separate and apart in the water phase so that they remain in a suspended state. In addition, the dispersing agent functions as a wetting agent which lowers the interfacial tension between the resin particles and the water.

In the absence of an effective dispersing agent, the resin particles will tend to coagulate, flocculate or gel. As mentioned briefly above, it is believed that the metal ions that are dissolved from the metallic surface and then oxidized by the acidic aqueous coating composition are responsible for causing the resin particles to deposit on the metallic surface by rendering the dispersing agent associated with the resin particles ineffective for maintaining the particles in their suspended state.

Resin dispersions for use in the composition described herein are well known and many are available commercially. They are made generally by emulsion polymerization in which one or more monomers are polymerized in water in the presence of dispersing agents or emulsifiers which function to solubilize the monomer, suspend monomer droplets and suspend also the polymeric particles which are produced by the polymerization reaction. An alternative method for preparing the resin dispersions is by post emulsification which includes stirring particles of the resin in water which contains a dispersing agent.

Dispersing agents which are used in resin dispersions are well known. In general, they are anionic or nonionic materials which have surface active properties. Some examples of dispersing agents are: sulfuric acid esters: sulphonic acids; materials containing amine and carboxyl groups; and various esters and amides.

Most resin dispersions or latices contain usually other ingredients such as opaque and extender pigments, and dispersants therefor, preservatives, anti-rust agents, foamers, pH buffers, protective colloids and plasticizers. The exact composition of most commercially available latices is proprietary information. Because of the many different ingredients comprising the dispersions they are very difficult to analyze. However, the basic ingredients and range of amounts thereof are known to those skilled in the art, and as mentioned above, many types are available commercially.

The amount of film-forming resin utilized in the acidic aqueous composition can vary over a wide range. The lower concentration limit is dictated by the amount of coating material needed to provide sufficient material to form a coating. The upper limit is dictated by the amount of material which can be dispersed in the acidic aqueous composition.

In formulating the coating composition, it is preferred that the other ingredients of the composition be added to the latex. Upon addition of the other ingredients to the latex, there is obtained a composition which can be characterized as an acidic aqueous solution of an oxidizing agent having dispersed therein resin particles.

The coating composition is acidic and thus contains acid. Any acid, present in an amount sufficient to impart a pH of less than 7 to the composition, can be used. Typical examples of mineral acids that can be used are sulphuric, hydrochloric, hydrofluoric, nitric, phosphoric, hydrobromic and hyroiodic. Examples of organic acids that can be used are acetic, chloracetic, trichloracetic, lactic, tartaric and polyacrylic acid. Examples of other acids that can be used are fluoboric, fluotitanic and fluosilicic. Hydrofluoric acid is a preferred acid.

It is noted also that an acid which contains an anion that functions an an oxidizing agent can be the source of not only hydrogen ion, but also the oxidizing agent. An example of such an acid is nitric acid.

It is preferred that the aqueous coating composition have a pH within the range of about 1.6 to about 3.8. Thus, the preferred amounts of acids are those which impart to the composition a pH within the preferred range.

The acid component dissociates, of course, to yield hydrogen ion and an anion. If it is desired to have a particular anion present in a composition such, as for example, fluoride ion, which gives particularly good results, and it is desired also to use an acid other than one which contains the particular anion, then the anion can be added by way of a soluble salt containing the anion.

Any oxidizing agent can be utilized in the coating composition. Examples of oxidizing agents that can be used are hydrogen peroxide, dichromate, perborate, bromate, permanganate, nitrite, nitrate, and chlorate. Oxidizing agents can be conveniently added to the composition in the form of its water soluble salt, such as for example alkali and ammonium salts. Particularly good results have been obtained when the oxidizing agent is one which releases oxygen in the acidic aqueous coating composition. The preferred oxidizing agents are hydrogen peroxide and dichromate, with hydrogen peroxide being most preferred. Hydrogen peroxide can be added conveniently to the composition in the form of a 30% aqueous solution. As to the source of dichromate, excellent results have been obtained by utilizing a dichromate salt, for example, calcium dichromate. However, any water soluble hexavalent chromium-containing compound, which forms dichromate in an aqueous acidic medium can be used. For example, chromates and chromic acid can be used as the source of dichromate.

The amount of oxidizing agent that should be used is an amount sufficient to provide an oxidizing equivalent of at least 0.01 per liter of the composition. (The term "oxidizing equivalent" when used herein means the number of grams of oxidizing agent used divided by the equivalent weight of the oxidizing agent. The equivalent weight of the oxidizing agent is the gram molecular weight of the agent divided by the change in valence of all atoms in the molecule which change valence (usually one element).) Amounts of oxidizing agent which provide an oxidizing equivalent somewhat below 0.01 can be used but preferably the oxidizing equivalent should be at least within the range of about 0.01. It appears that there is no critical upper limit as to the oxidizing equivalents that are used; however, it is preferred that the oxidizing agent be present in an amount such that the upper oxidizing equivalent value is about 0.2. However, it should be understood that the oxidizing agent can be used in an amount to provide an oxidizing equivalent much higher than 0.2, for example, one or more.

There appears hereinafter a description of a preferred coating composition for use in accordance with this invention. The preferred composition is one which contains a dispersed resin as the coating-forming ingredient, the source of the resin being latex thereof, in combination with fluoride ion and either hydrogen peroxide or dichromate as the oxidizing agent. More particularly the preferred aqueous acidic coating composition comprises:

a. about 5 gs/l to about 550 gs/l of resin dispersed in the composition, the source of the resin being a latex thereof;
b. about 0.4 g/l to about 5 gs/l of fluoride ion;
c. an oxidizing agent selected from the class consisting of $H_2O_2$ and dichromate, said agent being present in an amount sufficient to provide from about 0.01 to about 0.2 of oxidizing equivalent per liter of composition; and
d. hydrogen ion is an amount sufficient to impart a pH to the composition of about 1.0 to about 3.8.

As will be apparent from the discussion which follows, coating compositions can be formulated with above mentioned ingredients present in amounts outside of the ranges set forth above — the above described composition being a preferred one.

With respect to the resin component of the above described preferred composition, it is present in the composition in the form of dispersed particles. This aqueous resin dispersion is preferably supplied as a latex[1]. The latex should be stable, of course, in the presence of the other ingredients comprising the composition. The manifestation of an unstable latex or one which cannot be stabilized is the dispersed resin will precipitate, flocculate or gel.

[1] An authorative discussion concerning latex resins may be found in *Emulsion and Water Soluble Paints and Coatings* by Charles R. Martens, published by Reinhold Publishing Corporation, 1954.

Examples of commercially available latices which can be used include the following:

| TRADENAME | REPORTED COMPOSITION |
|---|---|
| Pliolite 491 | Styrene-butadiene |
| Acrylene 45 | Acrylic co-polymer |
| Catalin A-1464 | Acrylic co-polymer |
| Catalin A-1482 | Acrylic co-polymer |
| Geon 552 | Polyvinyl chloride |
| Hycar 2600X 91 | Acrylic co-polymer |
| Hycar 2600X 92 | Acrylic co-polymer |
| Catalin A-1422 | Acrylic co-polymer |
| Rhoplex HA-12 | Acrylic co-polymer |
| Poly-Em 40 | Polyethylene |
| Pliovic 400 | Acrylic co-polymer |
| Teflon | Tetrafluoroethylene |

Coating-forming latices other than those listed above, may be employed. However, the group of latices listed above has been found to give very satisfactory and acceptable results, and for this reason may be regarded as the preferred set of latex resin materials for use in the invention.

The amount of dispersed resin utilized in the coating composition can vary over a wide range. The lower concentration limit of the resin is dictated by the amount of resin needed to provide sufficient resinous material to form a coating. The upper limit is dictated by the amount of resin which can be dispersed in the acidic aqueous solution. Although higher or lower amounts can be used, it is preferred that the composition contain from about 5 to about 550 gs/l of resin. The volume of latex utilized to provide the desired amount of resin will vary depending on the amount of resin dispersed in the latex, as latices varying in solids content are of course available.

The concentration of the resin in the composition has an influence on the weight of coating that will be obtained, other factors held constant. Compositions with greater amounts of a particular resin will produce higher coating weights. For example in one series of experiments panels were immersed for one minute in a composition that contained 1.5 gs/l of hydrogen peroxide, 2 gs/l of fluoride ion (added as HF) and different amounts of acrylic resin, the source of which was Catalin A-1316 latex. When the acrylic resin content was about 12 gs/l a coating weight of 232.2 mgs/sq. ft. was obtained, whereas when the composition contained in the range of about 250 gs/l of acrylic resin, the weight of the coating was almost 1550 mgs/sq. ft.

As mentioned above, the preferred aqueous acidic coating composition for use in this invention contains fluoride ion. The optimum, preferred method of making the composition acidic and adding fluoride ion comprises the use of hydrofluoric acid. This acid permits a simple means for control over pH requirements of the composition and obviates the need for introducing the fluoride ion in the form of an alkali metal, ammonium or other salt. While coatings can be obtained by adding the fluoride in salt form, it is preferred to utilize hydrofluoric acid and avoid the use of salts which may give rise to undesirable cations in the coating composition or complicate pH adjustment. If the fluoride component is added in the form of a salt, the pH of the composition can be adjusted by the use of acids other than hydrofluoric or in combination with hydrofluoric. Examples of such acids include sulfuric, phosphoric, nitric and hydrochloric.

With respect to the fluoride ion concentration, amounts within the range of about 0.4 to about 5 gs/l of composition (calculated as F) are preferred. Nevertheless, higher or lower amounts can be utilized to provide coatings wherein the coating weight builds up as a function of time.

As noted hereinabove, the preferred pH value of the acidic coating composition is within the range of about 1.6 to about 3.8. This pH may be measured by any conventional means, the standard glass electrode method being conventional practice. However, due to the presence of fluoride ion in the coating solution, the pH value should be determined by rapidly observing the value obtained on initial immersion of the glass electrodes. Where the pH is permitted to fall below 1.6, the coating composition may tend to etch the metal surface. On the other hand, when the pH of the coating composition rises above about 3.8, the composition tends to impart very thin coatings to the metal substrate.

The oxidizing agent used in the preferred coating composition is hydrogen peroxide or dichromate ion ($Cr_2O_7$). Hydrogen peroxide is most preferred. The hydrogen peroxide can be added conveniently in the form of a 30% aqueous solution of hydrogen peroxide.

The dichromate constituent can be added in the form of a variety of water soluble hexavalent chromium-containing compounds. Examples of such compounds include chromic acid, potassium dichromate, magnesium dichromate, potassium chromate and sodium chromate. Any water soluble hexavalent chromium-containing compound, which in an aqueous acidic medium forms dichromate can be used. Preferred sources of the dichromate ingredient are dichromates, for example calcium dichromate. Particularly good results have been obtained by utilizing an aqueous solution of chromic acid and a calcium salt, for example calcium carbonate. In addition, particularly good results have been obtained by adding to the composition an aqueous solution made up from potassium dichromate and calcium acetate. It is preferred also that the source of dichromate be added to the latex used in the form of an aqueous solution of the hexavalent chromium-containing compound. 3½

The preferred amount of oxidizing agent is an amount sufficient to provide an oxidizing equivalent of about 0.01 to about 0.2 in one liter of the composition. Somewhat lesser amounts of the oxidizing agent which provide an oxidizing equivalent outside of the lower value can be utilized also. The upper equivalent value is not critical and can be much higher. For example, resinous coatings have been obtained when the amount of hydrogen peroxide used provided an oxidizing equivalent in excess of one. It has been observed that when dichromate is utilized as the oxidizing agent in amounts to provide oxidizing equivalents in the higher range, then higher amounts of fluoride should be used — for example 3½ to 5 gs., when the dichromate equivalent is within the range of about 0.1 to about 0.2.

As to particularly preferred amounts of the oxidizing agent, there should be utilized about 0.3 to about 3.0 g/l of hydrogen peroxide (approximately 0.02 to 0.2 equivalent) and from about 1 g/l to about 2 g/l of dichromate (approximately 0.03 to 0.055 equivalent). However, when an aqueous solution made up from chromic acid and calcium carbonate or when an aqueous solution made up from potassium dichromate and calcium acetate is used, then lower amounts of dichromate can be utilized and thicker coatings can be obtained, for example about 0.735 g/l to about 0.95 g/l of dichromate (approximately 0.02 to 0.03 equivalent).

The above described preferred composition can be utilized to good advantage to produce quality coatings, the thickness of which can be controlled by the time a metallic surface is immersed therein.

Other optional ingredients can be added to the coating compositions described above.

The addition of a coalescing agent can enhance the corrosion resistant properties of the coatings. Among the many coalescing agents which are available, it is preferred that ethylene glycol monobutyl ether, commonly known as butyl Cellosolve, be used. This particular agent demonstrates complete compatibility in various proportions in the coating composition of this invention, and imparts a high degree of adhesion with respect to bonding polymeric films. Examples of other coalescing agents than can be used are hexylene glycol, diethylene glycol monoethyl ether acetate, diethylene glycol monobutyl ether acetate and ethylene glycol monobutyl ether acetate.

With respect to the amount of coalescing agent used, it is preferred that from about 5 to about 30 grams (per liter of composition) of this agent be employed to realize the enhanced corrosion resistant and adhesion properties; nevertheless, higher or lower amounts can be utilized.

As an aid in assuring thorough wetting of the metallic surface during treatment, it is sometimes preferable to incorporate into the coating composition a small quantity of a wetting agent, such as up to about 0.15% by weight of the total composition, over and above that which may be present in the source of the coating-forming material, for example a latex. Use of wetting agents is preferred practice where the metallic surface to be treated is not thoroughly cleaned, since such agents permit wetting of the metallic substrate with removal of some or all of the contaminants present thereon. Preferably nonionic or anionic type wetting agents are used; they provide satisfactory degrees of wetting when incorporated into the coating composition of this invention. Examples of wetting agents that can be utilized are alkyl phenoxy polyethoxy ethanol and sodium salts of alkylaryl polyether sulfonate.

If desired, the coating composition used in the present invention may be formulated so as to provide decorative or aesthetic effects upon treated metallic surfaces. When applied to metallic surfaces, the colors of the coatings produced tend to vary depending on a number of factors, including for example, the conditions under which the coatings are dried or fused and the coating-forming material used. Variations in the color may be realized by adding to the composition commonly used water-dispersible pigments, such as for example, phthalocyanine blue, phthalocyanine green, carbon black or quinacridone red. Generally, these pigments provide excellent color variations with no sacrifice in coating quality. Any pigment that is compatible with the composition and does not make is unstable can be used.

The amount of pigment which may be employed will depend, as is well known in the art, upon the depth or degree of hue desired. It should be noted that when dispersible pigments are used, it is advantageous to employ a small quantity of a wetting agent, in accordance with the above discussion, to aid in dispersing the pigment and maintaining it in satisfactory dispersion.

The coating composition for use in the practice of this invention can be utilized to coat a variety of metallic surfaces. Particularly good results have been obtained in the coating of ferriferous and zinciferous surfaces.

Metallic surfaces which have thereon a previously formed coating also can be coated by the coating compositions described above. Such previously formed coatings may be of the crystalline or amorphous types. Process and compositions for applying such coatings are well known. By way of example, such coatings can include those that are generally referred to as phosphates, chromates oxalates, and oxides (anodized or chemically converted) coatings.

There follows a description of conditions under which a coating may be applied in the practice of this invention.

The time of immersion of a metallic surface in the coating composition may vary from as little as 30 seconds to as much as 10 minutes or even longer. However, it has been found that while coating weights increase with prolonged treating times, maximum coating weights seem to be realized within about 10 minutes time, so that longer exposure of the metal surfaces to the action of the coating compositions generally do no yield correspondingly heavier coating weights. This matter of coating weights is also dependent to some extent upon the type of coating-forming material employed, so that in any particular instance preliminary coating weight determinations may be run in order to ascertain the type of coatings which are likely to be obtained with a particular system. In the interest of ecomony, suffice it to say that it is preferred to operate utilizing coating cycles of from about 1 to about 5 minutes duration.

As was pointed out above, the coating weight, for a particular coating composition and type of metal surface being treated, tends to increase, up to a maximum, as the time of treatment is increased. Once the operating characteristics of a particular coating system have been ascertained, this fact cn be exploited to provide a convenient, readily variable, control parameter for securing the desired coating weight. If a light coating is desired, a short treating time can be employed, and when a heavy coating is desired, the treatment time can be lengthened. This advantage is unavailable to those using other types of resinous coating compositions because the coating weights obtained with other types of compositions are not, as a practical matter, a function of time.

With respect to coating bath temperature, this is preferably operated anywhere from ambient temperature, that is from about 20°C., up to about 40°C. If the coating bath temperatures are permitted to rise much in excess of about 40°C. it has been found that coating weights begin to decrease, so that if heavier coatings are desired they will not be obtained by raising the temperature — other factors held constant. Nevertheless, coatings can be produced when the temperature of the composition is in excess of about 40°C. Obviously, temperatures which render the composition unstable should be avoided. Since the coatings obtained at ambient temperature are completely satisfactory, it is preferred to operate at this temperature so as to obviate the necessity of maintaining heated bath compositions, and thus obtain a reduction in coating costs. Of greater importance, however, is bath stability, which is at its maximum at room temperature. It has been noted that with respect to latices, these are more stable at room temperature.

Nevertheless, some advantages can be obtained by immersing the metallic surface in a heated coating composition. With all factors held constant except the temperature of the coating bath, it has been found that higher weight coatings can be obtained as the temperature of the composition is raised. The coating weight begins to fall off as the temperature exceeds a certain limit, which limit will vary depending on the type of coating-forming material utilized in formulating the coating composition.

It is preferred that relative motion be maintained between the coating composition and the metallic surface immersed therein. This may be accomplished, for example, by stirring the composition with a mixer or by moving the surface in the composition. By maintaining relative motion between the surface and the composition, heavier or thicker coatings can be obtained. By way of example, it is noted that in one experiment wherein a metallic surface was moved in the composition, there was obtained a coating that weighed almost ten times as much as a coating formed on a surface that was simply immersed in the composition with no relative motion between it and the composition being maintained.

Coatings can be formed from the composition without utilizing electricity as is used in the electrocoat or electrodeposit process for painting metals. The metallic surface may have an electrical charge as a result of being immersed in the coating composition, but a charge applied from an external source is not needed.

Numerous exemplary compositions for forming resinous coatings as described above are set forth in the aforementioned applications Ser. Nos. 791,762 and 791,801 (now U.S. Pat. Nos. 3,592,699 and 3,585,084 respectively) and the examples of said applications are incorporated herein by reference.

As mentioned hereinabove, continued use of the caoting compositions described herein leads to their becoming unstable as a result of the build-up of excess oxidized metallic ions; as the ions build-up in concentration, the proportion or ratio of ions to dispersing agent increases. The ions render the dispersing agent for the dispersed resin particles ineffective for maintaining the particles in their dispersed state. It should be understood that in order for the composition to coat the metallic surface, the dispersed resin particles in the region of the metallic surface must be rendered unstable so that they deposit on the surface. In effect, an object of this invention is to maintain the resin particles in the aqueous phase of the composition in their dispersed state except for those particles in the region of or adjacent to the metallic surface.

In accordance with this invention this can be accomplished by controlling the amounts of excess oxidized metallic ions, that is, those ions dissolved from the metallic surface and then oxidized by the oxidizing agent, and the dispersing agent for the resin particles to maintain them in a proportion which is effective to prevent the dispersed resin from becoming unstable in the composition except in the region of the metallic surface.

In view of the numerous variables which are associated with the coating compositions described herein and the manner in which they are used, it is impractical, if not impossible, to state a numerical value for the proportion of excess oxidized metallic ions and the dispersing agents. The following factors can have a bearing on said proportion; the type of metal being coated; the specific type of resin dispersion comprising the composition, particularly the dispersing agents associated therewith; the rate of throughput of the metallic surfaces in the composition; and the extent to which the composition ionizes the metallic surfaces. It is noted also that the amount of dispersing agent usually associated with the resin is relatively small, for example, about 0.2 to 3 wt. %. This coupled with the numerous other ingredients that generally comprise a latex can make analysis of the composition difficult. For these reasons, it has been found more expedient to make certain empirical determinations respecting the operating characteristics of specific baths and then utilize these determinations as guidelines for adjusting or controlling the amounts of excess oxidized metallic ion and dispersing agent in the desired proportion or ratio.

In general, it will be most convenient to make the empirical determinations on a test bath and then use the determinations in operating a production bath. Two such determinations which can be made are recording the surface tension of the composition as it used to coat metallic surfaces and analyzing the bath for metallic ion content as it is used. These recordings and analyses should continue until the compositions become unstable.

An explanation of how these determinations can be used as guidelines for determining when to adjust the amounts of excess oxidized metallic ions and/or dispersing agent to maintain them in a proportion which will maintain the bath in a stable condition follows.

It has been found that as the composition is used, the metallic ions build up, the surface tension of the composition begins to rise and, if steps are not taken to control the stability of the compositions, the surface tension will continue to rise to a value at which the resin dispersion flocculates, gels, or coagulates throughout the composition thereby rendering it inoperative. By operating a given coating composition to a state of instability and recording the surface tension of the composition, the value at which any given composition tends to become unstable under typical operating conditions can be determined. This information can be used in future operation of a like composition. By recording the surface tension of the composition as metallic surfaces are processed through it, steps can be taken to avoid instability. For example, excess oxidized ions can be removed from the composition; or additional dispersing agent can be added to the composition thereby lowering the surface tension to its normal operating and stable value.

Periodic analyses of the metal content of an operating bath is another way for determining when the proportion of excess oxidized metallic ions and dispersing agent should be adjusted. It has been found, for any given coating composition, the composition will become unstable when the metallic ions build-up to a certain value. By operating a given coating composition to a state of instability and recording the metallic ion content, the concentration at which any given composition tends to become unstable under typical operating conditions can be determined. This information can be used in the future operation of a like composition to avoid instability. By recording the excess oxidized metallic ion concentration of the composition as metallic surfaces are processed through it, steps, as outlined above can be taken to avoid instability. Excess oxidized metallic ions can be removed from the bath thereby reducing the concentration thereof in the composition. Or additional dispersing agent can be added to the composition.

It has been found that for relatively long continued operating of the bath, it will be necessary to remove excess oxidized metallic ions from the bath. The addition of dispersing agent is effective to prolong stability of the bath to a certain extent, but as the metallic ions continue to build-up in concentration, further additions of dispersing agent are not effective to maintain stability. By way of example, it is noted that when utilizing a coating composition containing an aqueous dispersion of styrene-butadiene copolymer, HF and $H_2O_2$ to coat steel panels, the composition tended to become unstable as the ferric ion concentration exceeded about 1.5 g/l. The composition could be operated for prolonged periods by replenishing the ingredients as they were consumed and removing ferric ions periodically as their concentration approached about 1.5 g/l.

Bath stability of the same type of composition was prolonged also by adding periodically dispersing agent, instead of removing the ferric ions. However, when utilizing this method, it was found that the composition became unstable when the iron concentration in the bath reached about 3 g/l notwithstanding that additional amounts of dispersing agent were added to the composition. Thus, this method can be used effectively for applications in which the bath is not used extensively, but for extensive use it is necessary to remove eventually the excess oxidized metallic ions.

It is preferred that the aforementioned methods be used in combination. Dispersing agent can be added to prolong stability at relatively higher metallic ion concentration (this concentration can be determined by the empirical determinations described above) and the metallic ions can be removed from the bath.

It is noted also that many present commerically available latices, which can be used in the composition described herein, have a surface tension in the range of about 30 to about 40 dynes/centimeter. The addition of acid and oxidizing agent to such latices does not affect the surface tension thereof to any significant degree so that compositions prepared from such latices can have a like surface tension. (The surface tension of pure water is about 72 dynes/cm). In coating steel panels, it has been found that such compositions tend to become unstable as the surface tension rises to about 40 to about 50 dynes/cm. and as the iron in the bath builds-up to a concentration of about 1 to about 3 g/1 or higher. It should be understood that these values are exemplary and that for any given composition and specific use thereof the values can differ; however, they can be determined readily.

The excess oxidized metallic ions can be removed by any suitable method. It is preferred that they be removed by precipitating them from the composition.

When utilizing a preferred composition within the scope of this invention, that is one prepared from a latex and containing HF and $H_2O_2$ to coat an iron surface, it is preferred that the generated ferric ions be precipitated by adding $Ca(OH)_2$ to the composition. Ferric ions precipitate as $Fe(OH)_3$ as the pH of the composition is raised by the addition of $Ca(OH)_2$.

The use of $Ca(OH)_2$ has a number of advantages. No Ca ion is left in the composition because it precipitates as $CaF_2$. Thus, there is no build-up of this cation in the composition. (The fluoride which precipitates with the Ca can be replenished readily.) Other advantages of using $Ca(OH)_2$ are its very low cost and the ease with which it can be handled.

The $Ca(OH)_2$, which is preferably added in the form of an aqueous slurry, should be added in an amount sufficient to remove as much ferric ion as required to maintain bath stability. By way of example, it is noted that in the use of a preferred coating composition described herein to coat steel panels, most of the ferric ion was precipitated by raising the pH of the composition from about 2.5 to about 4.

Other materials which can be used to precipitate ferric ion include other alkaline earth metal hydroxides and oxides and alkali metal hydroxide. However, in utilizing NaOH, it has been found that the coatings formed from the resulting composition, which was adjusted subsequently to its operating pH by the addition of HF, were less resistant to water rinsing. In addition, when using NaOH, sodium ions tend to build-up concentration in the composition. The quality of coatings produced form such a composition is affected adversely.

The use of $Ca(OH)_2$ is very much preferred in the practice of this invention.

After the excess oxidized metallic ions are precipitated from the composition, the precipitate can be separated from the composition by filtration. This can be done in batch or on a continuous basis. Another method for removing the precipitate is centrifugation.

As to keeping the bath stable by the addition thereto of dispersing agent, any suitable dispersing agent can be used. In general, the dispersing agents will be of the anionic and/or non-ionic type. Preferably, the dispersing agent should be the one present in the aqueous resin dispersion used in formulating the coating composition. Examples of dispersing agents that can be used include alkyl aryl sulfonates and ethoxylated alkyl pheonols.

The dispersing agent should be added in an amount to maintain the surface tension of the coating composition at a value below that at which the composition tends to become unstable. Generally speaking, the amount will depend on the specific coating composition used, the conditions under which it is operated and the effectiveness of the specific dispersing agent added. Care should be exercised to avoid raising the pH to a valve which may cause the resin dispersion to be removed by filtration along with the iron preciptitate. For example, in utilizing $Ca(OH)_2$ to remove iron from an aqueous composition containing dispersed styrene-butadiene resin, HF and black pigment, it was found that the resin and pigment were removed from the aqueous phase of the composition along with the iron precipitate when the pH was above 9. Generally speaking, it is unnecessary to raise the pH to such high values to preciptiate the metallic ions.

It should be understood that as the coating composition is used to apply coatings to metallic surfaces, the ingredients thereof will be depleted. To maintain the ingredients in the composition in efective operating amounts, they have to be replenished. With respect to replenishing the resin in the composition, this can be accomplished most conveniently by adding additional aqueous dispersion of the resin to the composition. The aqueous resin dispersion utilized as the replenishing ingredient will, of course, contain a dispersing agent which maintains the resin in its dispersed state; thus, additional dispersing agent will be added to the composition. However, as mentioned hereinabove, it has been found that replenishment of the composition in this manner is not itself effective for maintaining bath stability. Thus, additional dispersing agent over and above the amount that is present normally in an aqueous resin dispersion utilized as a replenishing ingredient must be added to the composition when this method is used to maintain the stability of the bath.

After withdrawing the coated metallic surface from the acidic aqueous coating composition, it is preferred that the coating be rinsed with water to remove loose material that is dragged out of the coating bath.

The corrosion resistance of resin-coated metallic surfaces can be improved by rinsing with water followed by rinsing with an aqueous rinse solution containing chromium, for example, a dilute solution of chromic acid or a rinse solution containing $Cr^{+6}$/reduced Cr of the type disclosed in U.S. Pat. No. 3,063,877.

After the coating has been rinsed, it should be dried by allowing water to evaporate. The fusion of a polymeric resinous coating serves to render the coating continuous, thereby improving its resistance to corrosion and adherence to the underlying metal surface.

The conditions under which the drying operation is carried out depend somewhat upon the type of resin employed. Fusion characteristics of coatings formed from the various types of resins which can be utilized in practicing the invention are known and the drying conditions best utilized for a coating formed from a specific resin can be selected on the basis of previous experience. Some of the resins which are suitable for use in the invention do not require high temperatures for fusion, and for these resins air drying at ambient temperatures can be used. Drying can be accelerated by placing the coated surface in a heated environment. Most of the resinous coatings require heated drying stages, or baking, in order to fuse the resin and to insure that the desired corrosion resistance is obtained. In summary, while the drying operation can be performed at room temperature under some circumstances, it is generally preferred that it be done by oven drying or baking.

When a heated environment is used, the drying or fusion stage may be carried out at temperatures above 110°C., and preferably from 120° to 150°C. However, it is to be understood that whatever temperature is ultimately employed will depend, at least in part, on the particular resin utilized. For example, coatings formed from a polyethylene latex are satisfactorily fused within a temperature range of from 110°C to about 140°C.; tetraflurorethylene coatings require appreciably higher temperatures. Since the resinous materials are organic, they will tend to degrade if extremely high drying temperatures are employed, and it is, of course, preferred that such temperatures be avoided. This factor presents no difficulty in the operation of the invention, since adequate drying or fusion without degradation is easily obtainable by operation within the temperature ranges set out above.

Drying temperature is also partially dependent upon the time cycles employed. Where relatively short drying cycles are used, i.e., from 30 seconds to two or three minutes, higher oven temperatures are needed. If the drying cycle is of appreciably longer duration, such as for example 10 to 15 minutes, then generally lower temperatures can be utilized. Suffice it to say, the choice of drying conditions will be dictated by considerations of the type of coating formed and drying cycles contemplated.

It has been observed that metallic surfaces coated with the coating composition used in the practice of this invention have formed thereon an organic-inorganic coating, with the inorganic coating being sandwiched between the surface of the metal and the organic coating. The organic coating comprises the coating-forming material used in the coating composition. The nature of the inorganic coating has been difficult to characterize; however, when coating ferriferous surfaces, there has been found some evidence which would indicate that the inorganic coating is an oxide of the metal being coated, for example iron oxide. Thus, an inorganic coating and an organic coating are applied simultaneously to the metal substrate. Whatever the exact nature of the coatings, it is apparent that their corrosion resistant and adherent properties can be vastly superior to coatings produced by previous methods and that these properties can be further improved in accordance with this invention.

EXAMPLE 1

A 45 liter bath of the following composition was prepared:

| Ingredients | Amt/liter |
|---|---|
| an aqueous dispersion of 56 wt. % styrene-butadiene copolymer and containing an ethoxylated nonyl phenol dispersing agent* | 100 ml |
| HF | 2.1g |
| $H_2O_2$ | 1.8g |
| water | to make 1 liter |

*Pliolite 491 sold by Goodyear Tire and Rubber Co.

The pH of the above composition was 2. The composition contained also 5 ml/l of 75 wt. % $H_3PO_4$; this ingredient aids in improving corrosion resistance of the coatings. Cold rolled steel panels, 4 inches × 12 inches, were coated in the bath. The coatings weighed about 2000 mg/sq.ft. and had a thickness of about 0.8 mil. After processing about 360 sq. ft. of panels in the composition and replenishing the ingredients of the composition periodically as needed, the bath contained about 2.0 g/l of ferric ion. On the basis of previous experience with this composition, it was found that the composition became unstable as the amount of ferric ion built up to a concentration in excess of about 2 g/l. To prevent the composition of this example from becoming unstable, the coating operation was stopped and there was added to the bath an aqueous slurry of calcium hydroxide in an amount such that the pH of the composition was raised from 2 to about 5.5. Iron precipitated from the composition in the form of ferric hydroxide. The precipitate was removed from the composition by filtration. Thereafter, a sufficient amount of HF was added to restore the pH of the composition to 2. The coating operation was then resumed and additional panels were coated in the bath.

EXAMPLE 2

The above coating composition was used to coat additional steel panels and when the ferric ion concentration again built up to about 2 g/l, calcium hydroxide was added again as described above to precipitate additional iron. At this time about ½ of the resin that had been present in the original composition was consumed and the consumed resin was replenished. The surface tension of the composition was about 45 dynes/cm. On the basis of previous experience with this type of composition, it was found that if the surface tension was allowed to rise much higher, the bath became unstable. Therefore, about 0.03 wt. % of an ethoxylated nonyl phenol dispersing agent (Triton N-100 sold by Rohm & Haas Co.) was added to the composition to reduce the surface tension to a value of about 37 dynes/cm. The composition was used to coat additional panels. Periodically, the ingredients were replenished, iron was precipitated as described, and additional dispersing agent was added as described until there was consumed the amount of resin initially present. Following this procedure, it appeared that the bath could be used to to coat indefinitely.

EXAMPLE 3

There was prepared a 45 liter bath of the composition of Example 1. It was used to coat steel panels as described in Example 1. When the ferric ion content of the composition had built up to a concentration in excess of about 2 g/l, about 0.03 wt. % of ethoxylated nonyl phenol dispersing agent was added to the composition. This reduced the surface tension of the composition from 45 to 37 dynes/cm. As mentioned above, previous experience showed that this composition tended to become unstable at a ferric ion concentration in excess of about 2 g/l. However, after the addition of the dispersing agent, and continued use of the bath, it was found that it could be operated to coat panels effectively at ferric ion concentrations as of high as about 3 g/l. Maintaining the stability of the bath for additional coating required that ferric ion be precipitated.

I claim:

1. In the method wherein an organic resinous coating is applied to a metallic surface by immersing said surface in an acidic aqueous coating composition containing an oxidizing agent and dispersed solid particles of an organic coating-forming resin dispersed in said composition by a dispersing agent associated therewith, said dispersing agent and resin being present in a predetermined proportion, and wherein metal ions are formed by the dissolution of said metallic surface through the chemical action of said coating composition, and wherein said metal ions are oxidized to a form which renders said dispersed resin unstable in the region of said surface and wherein said unstabilized resin deposits and forms on said surface a resinous coating, the thickness or amount of which increases during at least a portion of the time said surface is immersed in said composition, and wherein said resinous coated surface is withdrawn from said composition and is heated to fuse the resin, and wherein additional metallic surfaces are immersed in said composition and are coated as set forth, and wherein ingredients of said composition are consumed as said surfaces are coated, and wherein additional amounts of said ingredients are added to said composition to replenish the concentrations thereof, and wherein as said metallic surfaces are coated as set forth, there is formed in said composition additional excess oxidized metal ions which tend to cause said dispersed resin to become unstable, not only in the region of said metallic surface, but also throughout the other portions of said coating compositions, as characterized by flocculation, coagulation or gelation of the dispersed resin particles, thereby rendering said composition inoperative for coating, the improvement comprising adding dispersing agent and resin to said composition in amounts to replenish these ingredients and in a proportion such that the proportion of said added dispersing agent to said added resin is greater than said predetermined proportion and sufficient to maintain the stability of said dispersed resin in said other portions of said composition thereby prolonging the operability of said coating composition.

2. The method according to claim 1 wherein said excess oxidized metal ions are removed from said composition.

3. In the method wherein an organic resinous coating is applied to a metallic surface by immersing said surface in an aqueous coating composition comprising:

i. hydrogen ion in an amount sufficient to make the composition acidic;

ii. fluoride ion;

iii. an oxidizing agent selected from the class consisting of hydrogen peroxide and dichromate; and iiii. solid particles of resin dispersed in said composition by a dispersing agent associated therewith, said dispersing agent and resin being present in a predetermined proportion; and wherein said ingredients are present in amounts such that said dispersed resin is rendered unstable in the region of said surface and wherein said unstabilized resin deposits on said metallic surface a resinous coating, the thickness of which increases during at least a portion of the time said surface is immersed in said composition, said coating being initially adherent to said surface, and wherein metal ions are dissolved from said surface by the chemical action of said coating composition, and wherein additional metallic surfaces are immersed in said composition and are coated as set forth, and wherein ingredients of said composition are consumed as said surfaces are coated, and wherein additional amounts of said ingredients are added to said composition to replenish the concentrations thereof, and wherein as additional metallic surfaces are immersed in said composition and are coated as set forth, said dispersed resin tends to become unstable, not only in the region of said metallic surfaces, but also in other portions of said coating composition, as characterized by flocculation, coagulation or gelation of the dispersed resin particles, thereby rendering said composition inoperative for coating, the improvement comprising maintaining the surface tension of said aqueous composition at a value at which said resin is maintained in its dispersed state, except in the region of said metallic surface, by adding to said composition dispersing agent and resin in amounts to replenish these ingredients and in a proportion such that the proportion of said added dispersing agent to said added resin is greater than said predetermined proportion and sufficient to maintain the stability of said dispersed resin in said other portions of said composition thereby prolonging the operability of said coating composition.

4. The method according to claim 3 including removing metal ions which are dissolved from said surfaces from said composition.

5. The method according to claim 1 wherein said composition has a surface tension within the range of about 30 to about 40 dynes/cm and wherein said surface tension is maintained within said range by adding to said composition said dispersing agent.

6. The method according to claim 5 wherein said surfaces are ferriferous surfaces and wherein said metal ions are iron ions.

7. The method according to claim 6 wherein said composition tends to become unstable as the surface tension of said composition rises to about 40 to about 50 dynes/cm and as said iron ions in said composition build up to a concentration of about 1 to about 3 g/l or higher, and wherein said surface tension is maintained below about 40 dynes/cm by the addition of said dispersing agent.

8. The method according to claim 3 wherein said composition has a surface tension within the range of about 30 to about 40 dynes/cm and wherein said surface tension is maintained within said range by adding to said composition said dispersing agent.

9. The method according to claim 8 wherein said surfaces are ferriferous surfaces and wherein said metal ions are iron ions.

10. The method according to claim 9 wherein said composition tends to become unstable as the surface tension of said composition rises to about 40 to about 50 dynes/cm and as said iron ions in said composition build up to a concentration of about 1 to about 3 g/l or higher, and wherein said surface tension is maintained below about 40 dynes/cm by the addition of said dispersing agent.

11. The method according to claim 1 wherein said composition contains:

i. about 5 to about 550 g/l of a polymeric coating-forming resin dispersed in the composition, the source of the resin being a latex thereof;

ii. about 0.4 to about 5 g/l of fluoride ion;

iii. hydrogen peroxide in an amount sufficient to provide from about 0.01 to about 0.2 of oxidizing equivalent per liter of composition; and iiii. hydrogen ion in an amount sufficient to impart a pH of about 1.6 to about 3.8 to the composition.

12. The method according to claim 11 wherein said surfaces are ferriferous surfaces and wherein said metal ions are iron ions.

13. The method according to claim 12 wherein said composition tends to become unstable as the surface tension of said composition rises to about 40 to about 50 dynes/cm and as said iron ions in said composition build up to a concentration of about 1 to about 3 g/l or higher, and wherein said surface tension is maintained below about 40 dynes/cm by the addition of said dispersing agent.

14. The method according to claim 13 wherein said excess oxidized iron ions are removed from said composition.

15. The method according to claim 14 wherein said resin is styrene-butadiene copolymer and wherein the amount of said oxidized iron ions removed from said composition is such that the amount thereof is maintained below about 3 g/l.

16. The method according to claim 15 wherein the amount of said oxidized iron ions is maintained below about 1.5 g/l.

17. The method according to claim 14 wherein said excess oxidized iron ions are removed from said composition by adding thereto an alkaline earth metal hydroxide or an alkaline earth metal oxide or an alkali metal hydroxide to precipitate them and wherein the resulting precipitate is separated from said composition.

18. The method according to claim 17 wherein said excess oxidized iron ions are precipitated by adding to said composition calcium hydroxide.

19. In the method wherein an organic resinous coating is applied to a metallic surface by immersing said surface in an acidic aqueous coating composition containing an oxidizing agent and dispersed solid particles of an organic coating-forming resin dispersed in said composition by a dispersing agent associated therewith, said dispersing agent and resin being present in a predetermined proportion, and wherein said ingredients are present in amounts such that said dispersed resin is rendered unstable in the region of said surface and wherein said unstabilized resin deposits on said metallic surface a resinous coating, the thickness of which increases during at least a portion of the time said surface is immersed in said composition, and wherein metal ions are dissolved from said surface by the chemical action of said coating composition, and wherein additional metallic surfaces are immersed in said composition and are coated as set forth, and wherein ingredients of said composition are consumed as said surfaces are coated, and wherein additional amounts of said ingredients are added to said composition to replenish the concentrations thereof, and wherein as additional metallic surfaces are immersed in said composition and are coated as set forth, said dispersed resin tends to become unstable, not only in the region of said metallic surface, but also in other portions of said coating composition, as characterized by flocculation, coagulation or gelation of the dispersed resin particles, thereby rendering said composition inoperative for coating, the improvement comprising adding dispersing agent and resin to said composition in amounts to replenish these ingredients and in a proportion such that the proportion of said added dispersing agent to said added resin is greater than said predetermined proportion and sufficient to maintain the stability of said dispersed resin in said other portions of said composition thereby prolonging the operability of said coating composition.

20. The method according to claim 19 including removing from said composition metal ions dissolved from surface.

21. The method according to claim 19 wherein said surfaces are ferriferous surfaces.

22. The method according to claim 20 wherein said surfaces are ferriferous surfaces and wherein iron ions are removed from said composition.

23. The method according to claim 1 wherein said surfaces are ferriferous surfaces.

24. The method according to claim 23 wherein said excess oxidized metal ions are ferric ions and including removing ferric ions from said composition.

25. The method according to claim 3 wherein said surfaces are ferriferous surfaces.

26. The method according to claim 25 wherein said metal ions are iron ions and including removing said iron ions from said composition.

* * * * *

UNITED STATES PATENT AND TRADEMARK OFFICE

CERTIFICATE OF CORRECTION

PATENT NO. : 3,936,546

DATED : February 3, 1976

INVENTOR(S) : Wilbur S. Hall

It is certified that error appears in the above-identified patent and that said Letters Patent are hereby corrected as shown below:

Column 1, line 47, "pain" should read --paint--;

Column 6, line 23, "1.0" should read --1.6--;

" line 40, in the footnote, "1954" should read --1964--;

Column 8, line 14, delete "3 1/2";

Column 9, line 64, "no" should read --not--;

Column 11, line 11, "caoting" should read --coating--;

Column 12, line 47, "operating" should read --operation--;

Column 13, line 55, "hydroxide" should read --hydroxides--;

" line 62, "form" should read --from--;

Column 14, line 21, "valve" should read --value--;

Column 15, line 25, "tetraflurorethylene" should read --tetrafluoroethylene--.

Signed and Sealed this

Twenty-first Day of September 1976

[SEAL]

*Attest:*

RUTH C. MASON
*Attesting Officer*

C. MARSHALL DANN
*Commissioner of Patents and Trademarks*